United States Patent [19]

Miles

[11] Patent Number: 4,771,756

[45] Date of Patent: Sep. 20, 1988

[54] SMALL GAME ARROW SLINGSHOT

[76] Inventor: Dennis P. Miles, 622 Blackworth, Miami, Okla. 74354

[21] Appl. No.: 54,731

[22] Filed: May 27, 1987

[51] Int. Cl.[4] ..... F41B 7/00

[52] U.S. Cl. ..... 124/22; 124/20 R

[58] Field of Search ..... 124/20 R, 20 B, 22, 124/30 A, 27; D22/106

[56] References Cited

U.S. PATENT DOCUMENTS

| | | | |
|---|---|---|---|
| 223,274 | 1/1880 | Bruce | 124/22 |
| 982,748 | 1/1911 | Setchell | 124/24 R |
| 2,600,250 | 6/1952 | Lake et al. | 124/24 R |
| 3,306,278 | 2/1967 | Spatari | 124/22 |
| 3,517,657 | 6/1970 | Alban | 124/20 B |
| 3,683,882 | 8/1972 | Braxton | 124/20 R |
| 4,307,699 | 12/1981 | Cuesta | 124/22 |

*Primary Examiner*—Anton O. Oechsle
*Assistant Examiner*—Gary Jackson
*Attorney, Agent, or Firm*—Leon Gilden

[57] ABSTRACT

A slingshot for an arrow includes a hand grip and attached arrow rest. The arrow rest includes permanently attached supports for the rubber sling and also includes several concavities formed on opposed surfaces which serve as projectile guides.

4 Claims, 2 Drawing Sheets

SMALL GAME ARROW SLINGSHOT

BACKGROUND OF THE INVENTION

1. Field of the Invention

The present invention generally relates to arrow projecting devices, and more specifically relates to an arrow slingshot which may be utilized for sport, hunting or target practice.

2. Description of the Prior Art

Numerous slingshot devices have been developed in the prior art which are adapated to propel elongated projectiles, such as arrows and the like. For example, U.S. Pat. No. 4,573,445, which issued to Webb et al on Mar. 4, 1986, discloses a slingshot for an arrow which includes a long barrel open at both ends and secured to the top portion of a hand grip. An arrow is positioned through the barrel and an attached sling is then used to provide the propelling force to the arrow. While being functional for its intended purpose, the Webb et al slingshot is somewhat complex to construct and expensive to manufacture. Accordingly, it apparently has not met with any commercial success.

Another typical example of an arrow projecting device is to be found in U. S. Pat. No. 4,437,449 which issued to M. Attanasio on Mar. 20, 1984. The device disclosed in this patent is substantially complex in design and consists of an elaborate frame structure which includes a hand grip and holding means for a sling. Due to the complex design and numerous interlocking parts, manufacturing difficulties and expense has apparently kept this device our of the commercial market.

Other patents of interest which disclose various types of arrow projecting slingshots include U.S. Pat. Nos. 3,517,657 which issued to J. Alban on June 30, 1970; 3,683,882 which issued to H. Braxton on Aug. 15, 1972; 4,307,699 which issued to J. Cuesta on Dec. 29, 1981; and Des. 157,223 which issued to P. White on Feb. 7, 1950. A review of these patents will reveal that all of the devices disclosed therein are substantially complex in design—at least from a manufacturing standpoint—and are therefore substantially expensive to individually manufacture. As such, these devices have also met with little apparent commercial success.

Accordingly, there would appear to be a continuing need for new and improved arrow projecting slingshots which are easy to transport, lightweight in design, and also easy and inexpensive to manufacture. In this respect, the present invention addresses this need.

SUMMARY OF THE INVENTION

In view of the foregoing disadvantages inherent in the known types of arrow projecting slingshots now present in the prior art, the present invention provides an improved arrow projecting slingshot construction wherein the same can be inexpensively and easily manufactured and which is adaptable for use by both left and right handed individuals. As such, the general purpose of the present invention, which will be described subsequently in greater detail, is to provide a new and improved arrow projecting slingshot which has all the advantages of the prior art arrow projecting slingshots and none of the disadvantages.

To attain this, the present invention comprises a plastic, wood or lightweight metal hand grip to which is integrally or otherwise attached an arrow guiding support. A pair of pins or eye bolts extend out of the arrow support and are utilized to effect an attachment of a sling, such as rubber surgical tubing, to the slingshot. Additionally, opposed surfaces of the support are concavely shaped so as to provide a guide and rest for an arrow to be projected from the slingshot. The opposed surface construction of the concave surfaces allows for the interchangeable use of the slingshot by either left or right handed individuals.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved arrow projecting slingshot which has all the advantages of the prior art arrow projecting slingshots and none of the disadvantages.

It is another object of the present invention to provide a new and improved arrow projecting slingshot which may be easily and efficiently manufactured and marketed.

It is a further object of the present invention to provide a new and improved arrow projecting slingshot which is of a durable and reliable construction.

An even further object of the present invention is to provide a new and improved arrow projecting slingshot which is susceptible of a low cost of manufacture with regard to both materials and labor, and which accordingly is then susceptible of low prices of sale to the consuming public, thereby making such arrow projecting slingshots economically available to the buying public.

Still yet another object of the present invention is to provide a new and improved arrow projecting slingshot which provides in the apparatuses and methods of the prior art some of the advantages thereof, while simultaneously overcoming some of the disadvantages normally associated therewith.

Still another object of the present invention is to provide a new and improved arrow projecting slingshot which is adaptable for use by either left or right handed individuals.

Yet another object of the present invention is to provide a new and improved arrow projecting slingshot which is of a substantially flat design so as to facilitate a carrying thereof by an individual within a coat pocket or the like.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
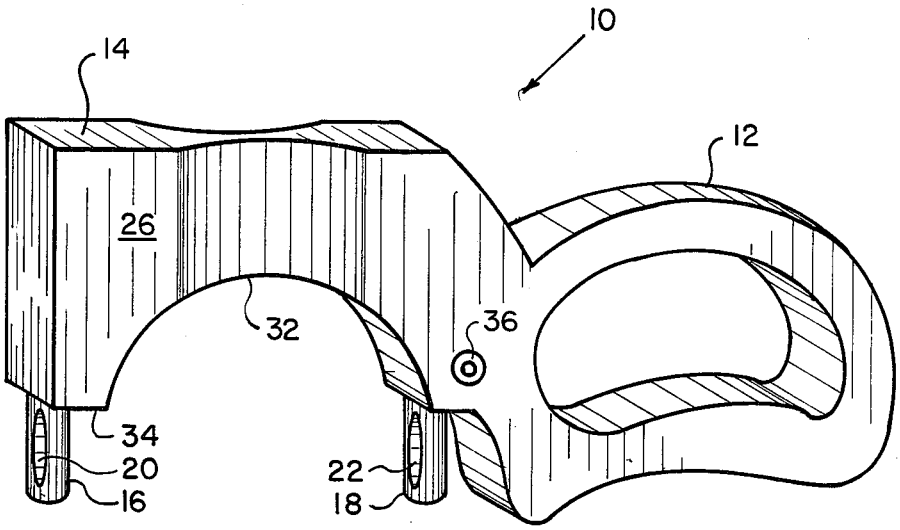
FIG. 1 is a perspective view of the arrow projecting slingshot comprising the present invention.
Figure 2:
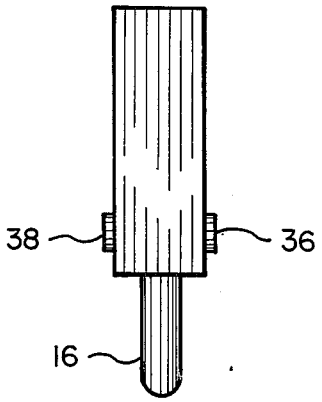
FIG. 2 is a top plan view of the slingshot.
Figure 3:
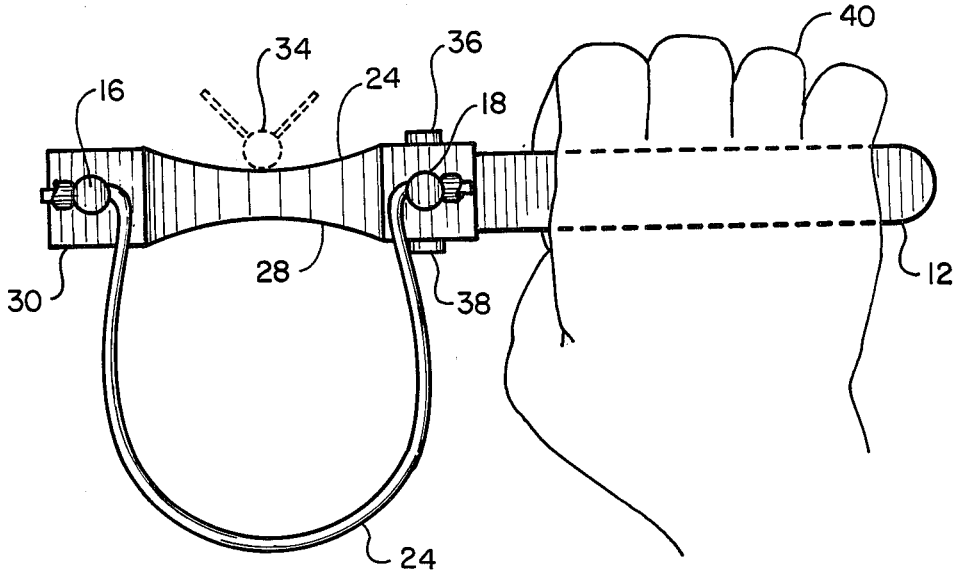
FIG. 3 is an elevation view of the slingshot showing the same being operably held by an individual.

With reference now to the drawings, and in particular to FIGS. 1, 2 and 3 thereof, a new and improved arrow projecting slingshot embodying the principles and concepts of the present invention and generally designated by the reference numeral 10 will be described.

More specifically, it will be noted that the slingshot 10 includes a handgrip portion 12 and a sling retaining support 14 integrally or otherwise separably attached to the handgrip. In a preferred embodiment, the integral construction of the slingshot 10 is facilitated by manufacturing the device in a plastic molding process. However, the slingshot 10 may be constructed from wood, lightweight metal, or any other conceivable material possessing the necessary strength and durability. As such, all such materials are within the intent and purview of the present invention.

With further reference to the drawings, it will be noted that a pair of eye bolts or pins 16, 18 extend out of the sling support 14 and are directed rearwardly therefrom. The pins 16, 18 include respective through-extending apertures 20, 22 through which a length of surgical rubber tubing 24, or the like, may be attached. The tubing 24 serves as the propelling sling as is well known in the art.

It will be further noted that the sling support 14 includes a first concave surface 24 formed on one side 26 of the support, and an opposed concave surface 28 integrally formed on the opposed face 30 of the support. Additionally, a deep concavity 32 is formed on the pin supporting surface 34. Each of these concave surfaces 24, 28, 32 serve as guides and rests for arrows 34 in a manner which will be subsequently described.

The slingshot 10 further includes a pair of upstanding sight receiving pins 36, 38. The sight pins 36, 38 are designed to fixedly retain a plurality of different types of sighting devices which are available on the commercial market and which are utilizable with slingshots.

As to the manner of usage and operation of the present invention, the same should be apparent from the above description. However, a brief summary thereof will be provided. More particularly, reference is made to FIG. 3 of the drawings wherein it can be seen that a right handed user can grasp the handgrip 12 with his right hand 40, and in this situation, the concave surface 24 will be used as a guide for an arrow 34. A small lightweight arrow 34 may be utilized with the slingshot 10, and the most desirable embodiment would include an arrow small enough to be carried in a user's pocket. If desired, a left handed user can use the slingshot 10 in a reversed manner and the concave surface 28 would then serve as an arrow support. In those situations where it is desired to use the slingshot 10 for propelling rocks and similar non-elongated projectiles, the slingshot can be held in the manner which allows the concave surface 32 to be directed upwardly, whereby the device resembles a conventional slingshot.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An arrow slingshot, comprising:

a. handgrip means;

b. sling support means attached to said handgrip means;

c. arrow rest and guiding means formed on said sling support means, said arrow rest and guiding means comprising a first concave surface integrally formed on said sling support means;

d. a second concave surface formed on an opposed face of said sling support means, said first and second concave surfaces facilitating an interchangeable use of said slingshot by left and right handed individuals; and, e. a third concave surface formed between said first and second concave surfaces, said third concave surface facilitating a use of said slingshot for non-elongated projectiles.

2. The arrow slingshot as described in claim 1, wherein said sling support means includes first and second sling retaining pins fixedly secured to said sling support means.

3. The arrow slingshot as described in claim 2, and further including first sight retaining means formed on a first surface of said sling support means.

4. The arrow slingshot as described in claim 3, and further including second sight retaining means formed on a further surface of said sling support means.

* * * * *